United States Patent [19]

Courmier et al.

[11] Patent Number: 4,923,021

[45] Date of Patent: May 8, 1990

[54] COMBINATION BIT FOR COKING OVEN

[75] Inventors: Veatchel A. Courmier, De Quincy, La.; Jerry L. Carnes, Midland, Pa.; Rahn Drost, Sulfur, La.

[73] Assignee: Conoco Inc., Ponca City, Okla.

[21] Appl. No.: 292,290

[22] Filed: Dec. 30, 1988

[51] Int. Cl.[5] ..... B08B 9/04; C10B 43/02; E21B 7/18

[52] U.S. Cl. ..... 175/382; 175/385; 175/424; 15/104.05; 134/24; 134/39; 134/167 R; 202/241; 239/247; 239/248; 239/587; 239/DIG. 13

[58] Field of Search ..... 299/16, 17, 79, 81; 175/382, 385, 391, 393, 424; 202/241; 201/2; 408/60, 61; 15/104.12, 104.16, 246.5, 104.5; 134/22.12, 22.18, 24, 166 C, 172, 198; 208/48 R; 196/122; 239/551, 565, 587, 579, 248, DIG. 13, 247; 137/862, 874, 876, 883

[56] References Cited

U.S. PATENT DOCUMENTS

| | | | |
|---|---|---|---|
| 2,217,360 | 10/1940 | Court | 175/424 |
| 2,218,130 | 10/1940 | Court | 175/424 |
| 2,245,554 | 6/1941 | Court | 134/24 |
| 2,245,575 | 6/1941 | Court | 134/24 |
| 2,254,848 | 9/1941 | Holveck | 134/24 |
| 2,306,926 | 12/1942 | Allen | 134/24 |
| 3,645,346 | 2/1972 | Miller et al. | 175/424 |
| 3,880,359 | 4/1975 | Novy | 202/241 |
| 4,611,613 | 9/1986 | Kaplan | 202/241 |
| 4,826,087 | 5/1989 | Chinery | 239/551 |

*Primary Examiner*—Bruce M. Kisliuk

[57] ABSTRACT

A combination bit for both drilling a pilot hole and cutting coke from a coking drum. A manually operable flow divider/diverter valve permits a single workman to quickly and easily change from pilot hold drilling mode to cutting mode without having to change bits.

17 Claims, 2 Drawing Sheets

COMBINATION BIT FOR COKING OVEN

BACKGROUND AND SUMMARY OF THE INVENTION

In the manufacture of both fuel grade and anode-quality petroleum coke, a critical step is cutting the coke out of the coking drum (or oven). Conventional methods employ the use of two cutting bits: a pilot bit to drill a pilot or access hole through the coke, and a cutting bit for removing the remaining coke from the drum. This conventional method requires a minimum of two workmen to change over from the pilot bit to the cutting bit, is time consuming, and involves an element of risk from a safety standpoint since the workmen are required to manipulate (detach, slide apart, lift, slide together, attach) heavy pieces of equipment.

Some attempts to build a functional combination bit (i.e., a single bit capable of both drilling the pilot hole and the standard coke cutting) have met with limited success. One such attempt utilizes a spring to bias the flow controller to a first pilot position and pneumatic pressure to move the controller to a second cutting position. However, both the spring and the pneumatic valve are subject to plugging by the water-borne coke fines in the hydraulic operating fluid and in which the cutting bit is immersed. When the spring and/or valve become clogged, the cutting bit becomes wholly or partly inoperable. Further, because the flowpath for the hydraulic fluid in this tool creates turbulence, a 10% loss in hydraulic pressure results, with a corresponding loss in efficiency.

The present invention overcomes these difficulties by providing a combination bit that is manually operable to switch from a pilot mode to a cutting mode. This changeover can be accomplished by a single workman unbolting a nosepiece portion, rotating it through 90° and rebolting it in place. This rotates an inner sleeve with two sets of flow ports from a first position where the first set of flow ports is aligned with the pilot nozzles to a second position where a second set of flow ports is aligned with the cutting nozzles. A stream diverter/divider positioned at the distal end of the combination bit's body provides optimum fluid transition to the cutting jets minimizing loss of fluid pressure and therefore maximizing efficiency. It should be noted that manual operable control means herein comprises an inner sleeve received within a cylindrical body portion, having a first plurality of flow ports for said first plurality of jet nozzles and a second plurality of flow ports for said second plurality of jet nozzles. The first and second plurality of flow ports alternatively provide fluid flow to said first plurality of said second plurality of jet nozzles, at the selection of an operator.

Various other features, characteristics and advantages of the present invention will become apparent after a reading of the following detailed description of the preferred embodiments.

BRIEF DESCRIPTION OF THE DRAWINGS

The details of the preferred embodiments are depicted in FIGS. 1–5 in which like reference numerals are used to identify like parts and in which.

DETAILED DESCRIPTION OF THE PREFERRED EMBODIMENTS

Figure 1:
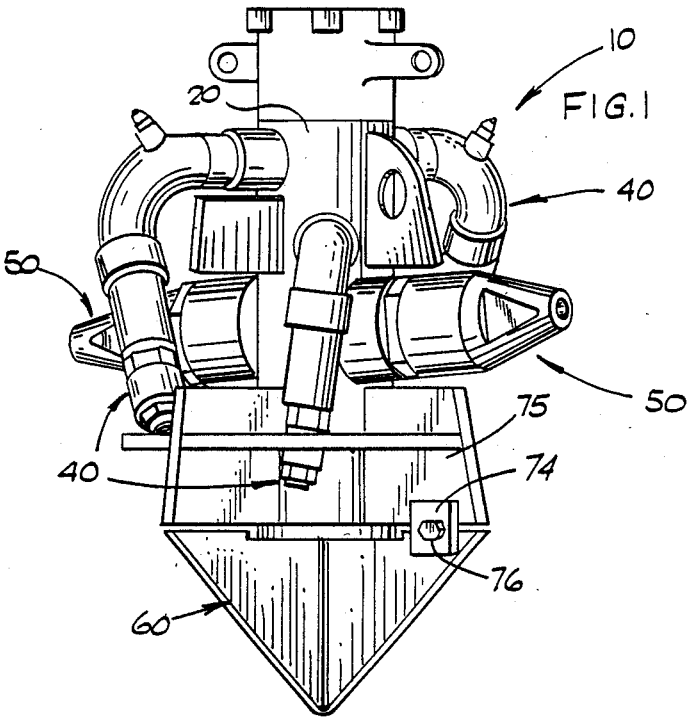
FIG. 1 is a schematic side elevation of the combination cutting bit of the present invention.

The combination cutting bit of the present invention, useful for removing coke from a coking drum and the like, is shown in FIG. 1 generally at 10. The combination bit 10 includes a generally cylindrical body portion 20, a first plurality of cutting elements 40 extending substantially axially along body 20 for drilling a pilot hole, a second plurality of cutting elements 50 extending substantially radially from body 20 for subsequent coke removal, the first and second plurality of cutting elements preferably being hydraulic jet nozzles, and an adjustable nose piece 60.

Figure 2:
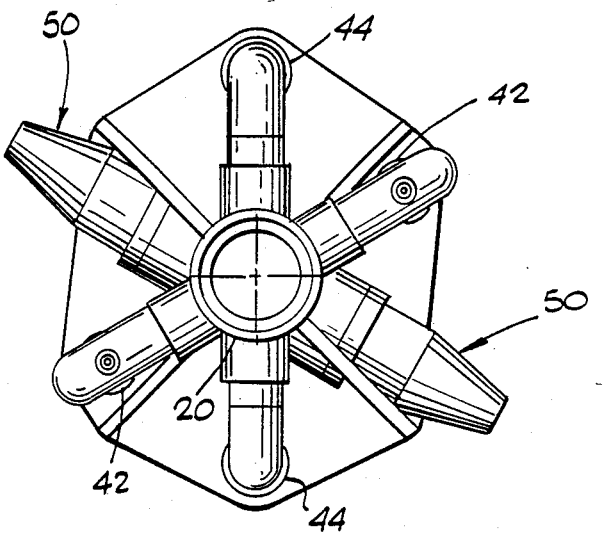
FIG. 2 is a top elevation of the bit as shown in FIG. 1.
Figure 3:
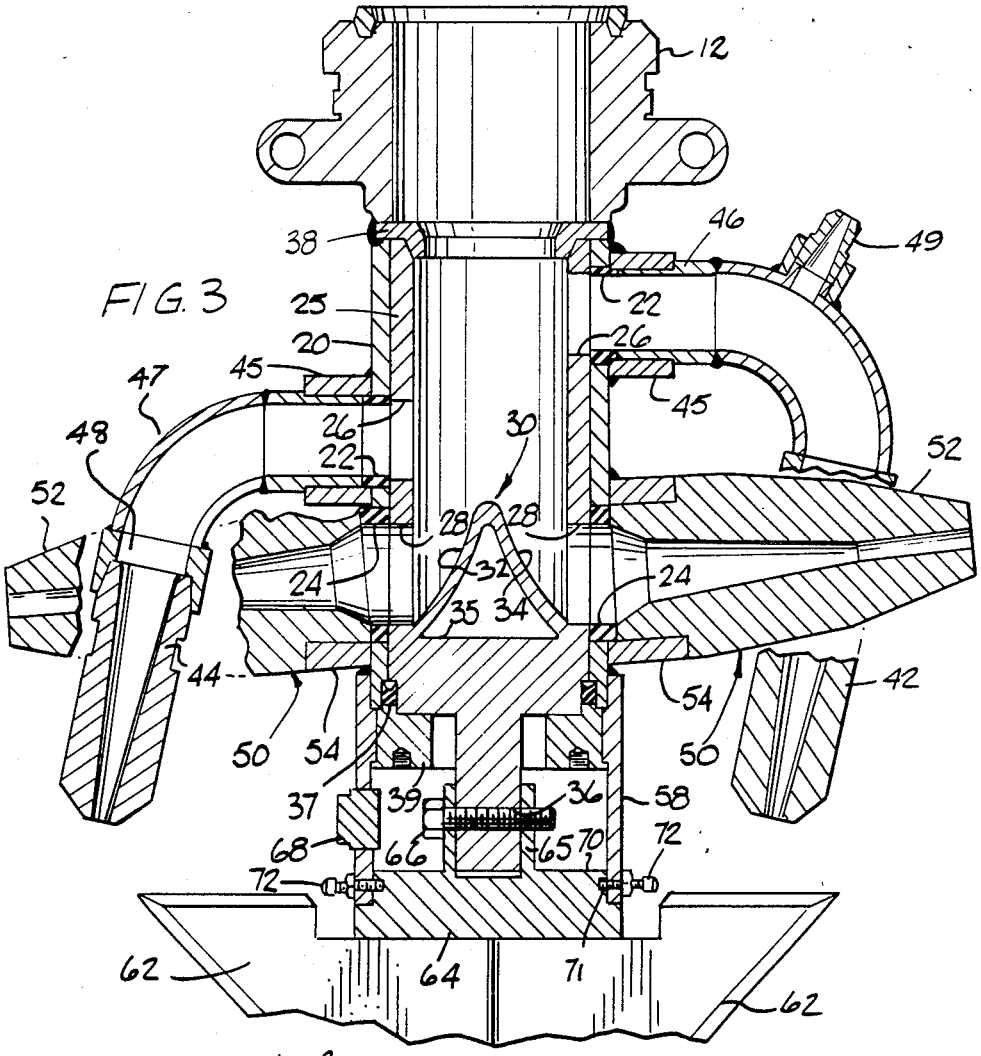
FIG. 3 is a side elevation in partial section with parts broken away and showing simultaneous fluid engagement with all jet cutting elements for clarity of explanation (though such engagement is not possible)
Figure 4:
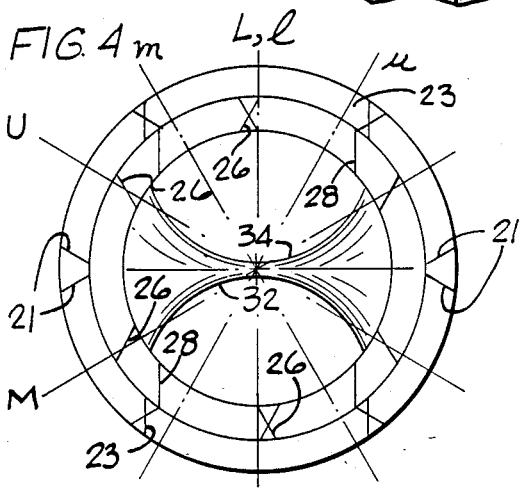
FIG. 4 is a detailed top elevation showing the relative positions of the ports in the inner and outer sleeves of said combination bit body.

The particulars of the cutting bit 10 are better seen in FIG. 3. It is noted, however, that in FIG. 3, for purposes of simplifying the drawing, one each of the three pairs of circumferentially displaced nozzles has been drawn in the same plane. For actual relative position of the cutting nozzles, reference should be made to FIGS. 1, 2 and 4.

In the preferred embodiment, there are four jet nozzles comprising the first plurality of cutting elements 40: a first opposed upper pair of nozzles 42 and a second opposed middle pair of nozzles 44. Each nozzle 42, 44 is attached to generally cylindrical body portion 20 by means of a pilot nozzle sleeve 45 welded to body 20, a pilot nozzle seal 22 partially received within the pilot nozzle sleeve 45, a pilot nozzle seal retainer 46 threaded into sleeve 45 and tack welded thereto to maintain a particular orientation, a 90° elbow 47 welded to the protruding end of seal retainer 46, and a threaded coupling 48 welded to the protruding end of elbow 47 which threadingly receives nozzle 42, 44. The inner periphery of seal 22 conforms to the outer circumference of inner valve cylinder 25 (FIG. 3). A back angled nozzle 49 is attached to each of the upper elbows 47 to prevent backfill from locking the cutting bit in the drilled pilot hole. Nozzles 42 are angled from the longitudinal axis of cylindrical body by 11° in a first plane and 7° in a second orthogonal plane. Nozzles 44 are angled by amounts of 7° and 11° in the two respective planes, the nozzles 42 and 44 being angled in opposite directions on opposite sides of the body 20. The nozzles 42 and 44 engage the coke in different cutting planes.

Similarly, a second plurality of cutting elements 50 comprise a pair of opposed hydraulic jet cutting nozzles 52 extending generally radially outwardly from the generally cylindrical body portion 20. Nozzles 52 are interconnected to a body 20 by means of cutting nozzle sleeve 54 which threadingly receive nozzles 52. The cutting nozzle seal 24 also has a curved inner periphery that conforms to the outer radius of inner valve cylinder 25. Further, because nozzles 52 are canted 5° from perpendicular to the longitudinal axis of body 20, the cutting nozzle seats 24 are tapered (one upwardly one downwardly) to accommodate this inclination. The canting of the plane of the nozzles 52, enable them to cut more effectively by impacting the surface of the coke surrounding the cutting bit 10 at other than a right angle along the helical path generated by its rotation and advancement into the coking oven. The inwardmost end of nozzle 52 engages seal 24 and serves as a backing member forcing seal 24 into engagement with the outer surface of valve cylinder 25.

Within cylindrical body 20, inner valve cylinder 25 is mounted to permit oscillatory rotary movement for purposes of adjustment. Cylinder 25 has a first plurality of pilot valve openings 26 which align with corresponding openings 21 in outer cylindrical body 20 when the cylinder is in a first position. When cylinder 25 is in a second position (FIG. 4) a second plurality of larger cutting valve openings 28 align with a second plurality of larger cutting nozzle openings 23 in outer cylindrical body 20. In the pilot position, the centerline u of upper pilot valve openings 26 aligns with the centerline U of upper openings 21 of nozzles 42 and the centerline m of middle pilot valve openings 26 aligns with centerline M of openings 21 of nozzles 44.

A flow diverter/divider 30 is affixed to the bottom portion of inner valve cylinder 20 as by welding. Diverter 30 has an arcuate left portion 32 (FIG. 3) and an identical arcuate right portion 34. Portions 32 and 34 are actually segments of 90° elbow halves welded back-to-back with a built up nose portion. The flow diverter/divider 30 minimizes the amount of disruption to the hydraulic fluid and significantly reduces the pressure (and hence, efficiency) losses from on the order of 10%, or greater, to the 1–2% range. Having the cutting nozzles at the trailing end of the cylindrical body 20 (trailing in the hydraulic flow path sense), further helps minimize the losses due to turbulent flow and maximize the energy utilized in cutting the coke.

A base member 35 is secured to inner valve cylinder 25, as by welding. An elastomeric seal 37 is positioned between outer cylindrical body 20 and inner valve cylinder 25. A lower retainer 39 is threaded into lower housing 58 to serve as a lower limit of movement for cylinder 25. The upward movement of cylinder 25 is limited by upper retainer 38 whose inwardly protruding lip overlaps the upper edge of cylinder 25. Upper retainer 38 is welded to the top of cylindrical body 20 and one lug 12 of a quick connect attachment is welded atop retainer 38. One such quick connect attachment identified by the registered trademark UNIBOLT is available from Thornhill-Craver. The other lug of the connecting pair will be secured as by welding to the end of a 6" diameter drill pipe from which the threads have been removed (not shown).

Nosepiece 60 comprises four vanes 62 (two shown) which lead the combination bit 10 into the coke drum (not shown). Vanes 62 are welded to the base 64 of nosepiece 60. A pair of ears 65 of base 64 engage a lower extending portion of base member 35 of valve cylinder 25. A connecting bolt 66 is threadingly received in the distal ear 65 to secure nosepiece 60 to valve cylinder 25. An access plug 68 is threaded into an aperture in lower housing 58 to permit installation and removal of connecting bolt 66. Lower housing 58 is itself welded at its upper edge to cylindrical body 20. As a backup safety measure, base 64 is provided with a protruding flange 70 above a lateral recess 71 which receives four retaining pins 72. In the event connecting bolt 66 shears, retaining pins 72 will prevent the nosepiece 60 from becoming separated from the body of combination bit 10 and being lost in the coking drum. A pair of securing plates 74 sandwich flange 75 secured to body 20 and one of two of the vanes 62 by means of a nut (not shown) and bolt 76 to secure nosepiece 60.

In use, combination bit 10 is attached to the lead end of a conventional drill string, preferably using a quick connect coupling as described supra. Nosepiece 60 will be oriented to and bolted in its pilot position (indicia may be included on reinforcing flanges 75 and vanes 62 to insure proper alignment). In this position, inner valve cylinder's (25) pilot valve openings 26 are aligned with pilot nozzle openings 21. Cutting valve openings 28 are turned to a position surrounded by the walls of outer cylindrical body 20. The drill pipe is connected to a source of hydraulic fluid by a flexible supply hose (not shown). The hydraulic source preferably includes a commercially available pump capable of producing in the range of 3200–3400 psi pressure.

The combination bit has shown the ability to drill an approximately three foot diameter hole through anode-quality coke (coking drum 90 feet long with an 11 foot diameter) in 3–5 minutes when rotated at low (10–20) rpms. Once the pilot hole is completed, the combination bit is removed from the top of the coking drum, backangled nozzles 49 helping to stir the coke slurry above the bit and prevent its becoming jammed. Once removed, a single workman can remove locking bolt 76 and securing plates 74, rotate nosepiece 60 90° to a cutting position and resecure it in the cutting position. Each of the two vanes 62 and flange 75 which are to be involved in the securement can be notched to ease entry of bolt 76. The notches serve as further indication that the proper adjustment has been made. In the cutting position, the pilot valve openings 26 are turned to the wall of body 20 and cutting valve openings 28 are aligned with cutting nozzle openings 23 in body 20. Diverter/divider 30 splits the stream and maximizes the hydraulic force nozzles 52 deliver to the coke in the drum. The time needed for drilling the pilot hole, changing modes and cutting the coke from the drum has been reduced from a total time of 75–85 minutes to a time of 50 to 60 minutes.

Figure 5:
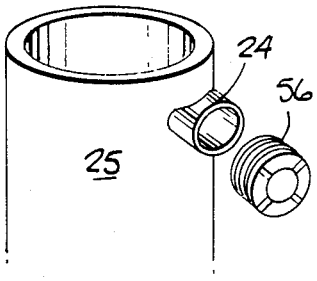
FIG. 5 is an exploded perspective view depicting the manner in which the fluid seals may be adjusted for wear.

In an alternate embodiment depicted in FIG. 5, the position of seals 22, 24 can be adjusted for wear to the seals or outer surface of the inner valve cylinder 25 by means of a retaining member or backing nut 56. This nut 56 is threadingly engaged in sleeves 45 and 54 and is provided with a pair of orthogonal grooves in its outermost face to permit adjustment by a screwdriver-type tool (not shown). As wear occurs (as will be evidenced by fluid pressure losses), adjustment of the backing nut 56 will eliminate the wear-induced slot in engagement between seals 22, 24 and cylinder 25 and the associated pressure losses.

The combination bit of the present invention provides a simple, yet reliable, alternative to the conventional two bit system. Various changes, alternatives and modifications to the preferred embodiments will become apparent following a reading of the foregoing specification. Accordingly, it is intended that all such changes alternatives and modification as fall within the scope of the appended claims be considered part of the present invention.

We claim:

1. Apparatus for cutting coke from a generally cylindrical coking oven having a given diameter, said apparatus comprising a cutting bit having a generally cylindrical body portion, a first set of cutting elements extending from said body portion and arranged for drilling a pilot hole which has a first relatively small diameter through said coke in said coking oven, wherein said first set of cutting elements comprises a first plurality of hydraulic jet nozzles extending in a direction 11° from parallel to a longitudinal axis of said body portion of said cutting bit in a first plane;

said cutting bit also having a second set of cutting elements extending from said body portion and arranged for cutting a larger hole which has a second relatively larger diameter through said coke in said coking oven;

manually operable control means mounted on said cutting bit for switching operability of said cutting bit from said first set of cutting elements to said second set of cutting elements, said control means being manually operably by a single workman upon removal of said cutting bit from said coking oven.

2. The apparatus for cutting coke according to claim 1 wherein said second set of cutting elements comprise a second plurality of hydraulic jet nozzles extending generally radially from a longitudinal axis of said body portion of said cutting bit.

3. The apparatus of cutting coke according to claim 2 further comprising a plurality of generally 90° elbows between said body portion of said cutting bit and said first plurality of cutting elements, at least some of said elbows being equipped with backangled flow nozzles.

4. The apparatus for cutting coke according to claim 2 wherein said manually operable control means comprises an inner sleeve received within said body portion and having a first plurality of flow ports for said first plurality of jet nozzles and a second plurality of flow ports for said second plurality of jet nozzles.

5. The apparatus for cutting coke according to claim 4 wherein said first and second plurality of flow ports alternatively provide fluid flow to said first plurality of said second plurality of jet nozzles, at the selection of said operator.

6. The apparatus for cutting coke according to claim 5 wherein said manually operable control means further comprises a pivotable nose piece that may be bolted in a first position wherein said first plurality of flow ports are aligned with said first plurality of jet nozzles for pilot hole drilling and may be pivoted to and bolted in a second position wherein said second plurality of flow ports are aligned with said second plurality of jet nozzles for cutting said larger diameter hole.

7. The apparatus for cutting the coke according to claim 6 further comprising generally cylindrical seal means received in said body portion in a region of said flow ports and in a position to engage and seal against an outer cylindrical surface of said inner sleeve.

8. The apparatus for cutting coke according to claim 7 further comprising means to adjust the position of said seal means to bring said seal means into more intimate engagement with said inner sleeve.

9. The apparatus for cutting coke according to claim 2 wherein each of said second plurality of nozzles which extend generally radially from said longitudinal axis of said cutting bit forms an angle of 5° with a plane which is orthogonal to said longitudinal axis in order to form a generally helical cut as said cutting bit is advanced into said oven.

10. The apparatus for cutting coke according to claim 1 wherein said first set of cutting elements further includes a second pair which extend in a direction 7° from parallel to said longitudinal axis in a second plane which is generally perpendicular to said first plane.

11. A hydraulically operated combination cutting bit comprising a body portion, a first plurality of jet cutting nozzles extending from said body portion positioned to drill a first relatively small diameter pilot hole through a solid materials;

a second plurality of get cutting nozzles extending from said body portion positioned to cut a second larger diameter hole through said solid material;

a manually operable diverter valve means for directing hydraulic cutting fluid to either said first or said second plurality of nozzles, wherein said diverter valve means comprises a rotatable inner sleeve member with a first set of flow ports aligning with said first plurality of jet cutting nozzles when in a first position and a second set of flow ports aligning with said second plurality of jet cutting nozzles when in a second position.

12. The hydraulically operated combination cutting bit of claim 11 including a nosepiece secured to said rotatable inner sleeve and operable to rotate it between and secure it in said first and second positions.

13. The hydraulically operated combination cutting bit of claim 12 wherein said first plurality of jet cutting bits extend in a direction generally parallel to said body portion and said second plurality of cutting bits extend in a direction generally radial to a longitudinal centerline of said body portion.

14. The hydraulically operated combination cutting bit of claim 11 wherein said diverter valve means further comprises a flow divider and diverter positioned at an end of said body portion.

15. The hydraulically operated combination cutting bit of claim 11 further comprising a generally cylindrical seal means positioned between each of at least some of said first and second plurality of jet cutting nozzles and said inner sleeve member.

16. The hydraulically operated combination cutting bit of claim 15 further comprising adjustable retaining members positioned within a portion of each nozzle equipped with said generally cylindrical seal means and manipulatable to adjust both the position of said seal means and an engagement force between said seal means and said rotatable inner sleeve.

17. The hydraulically operated combination cutting bit of claim 11 wherein said second plurality of jet cutting nozzles extends from said body portion at a location axially further from a source of hydraulic fluid for operating said combination cutting bit than said first plurality of jet cutting nozzles.

* * * * *